US011220319B2

(12) United States Patent
Yule

(10) Patent No.: US 11,220,319 B2
(45) Date of Patent: Jan. 11, 2022

(54) THRUSTER APPARATUSES, AND METHODS OF OPERATING SAME

(71) Applicants: Kobelt Manufacturing Co. Ltd., Surrey (CA); Dean Yule, New Westminster (CA)

(72) Inventor: Dean Yule, New Westminster (CA)

(73) Assignee: Kobelt Manufacturing Co. Ltd., Surrey (CA)

( * ) Notice: Subject to any disclaimer, the term of this patent is extended or adjusted under 35 U.S.C. 154(b) by 43 days.

(21) Appl. No.: 16/349,223

(22) PCT Filed: Nov. 9, 2017

(86) PCT No.: PCT/CA2017/051338
§ 371 (c)(1),
(2) Date: May 10, 2019

(87) PCT Pub. No.: WO2018/085933
PCT Pub. Date: May 17, 2018

(65) Prior Publication Data

US 2020/0189709 A1 Jun. 18, 2020

Related U.S. Application Data

(60) Provisional application No. 62/420,494, filed on Nov. 10, 2016.

(51) Int. Cl.
*B63H 25/42* (2006.01)
*B63H 5/125* (2006.01)
(Continued)

(52) U.S. Cl.
CPC ..... *B63H 25/42* (2013.01); *B63H 5/125* (2013.01); *B63B 13/02* (2013.01); *B63H 21/17* (2013.01);
(Continued)

(58) Field of Classification Search
CPC ..... B63H 25/42; B63H 25/125; B63H 2025/425; B63H 2025/465; B63H 21/17; B63H 5/125; B63B 13/02
See application file for complete search history.

(56) References Cited

U.S. PATENT DOCUMENTS 1,235,817 A 8/1917 Lape
3,002,486 A 10/1961 Järdmo
(Continued)

FOREIGN PATENT DOCUMENTS

CA 1 160 911 A 1/1984
EP 0 251 995 A2 1/1988
(Continued)

OTHER PUBLICATIONS

Written Opinion of the International Searching Authority, dated Jan. 19, 2018, for International Application No. PCT/CA2017/051338, 6 pages.
(Continued)

*Primary Examiner* — Stephen P Avila
(74) *Attorney, Agent, or Firm* — Seed IP Law Group LLP

(57) ABSTRACT

A method of operating a thruster apparatus involves causing a first propeller to rotate in response to pressure of a first flow of pressurized hydraulic fluid, and causing a second propeller to rotate in response to pressure of a second flow of pressurized hydraulic fluid separate from the first flow of pressurized hydraulic fluid. Thruster apparatuses are also disclosed.

18 Claims, 12 Drawing Sheets

(51) Int. Cl.

| | |
|---|---|
| *B63B 13/02* | (2006.01) |
| *B63H 21/17* | (2006.01) |
| *B63H 25/46* | (2006.01) |

(52) U.S. Cl.
CPC .. *B63H 2025/425* (2013.01); *B63H 2025/465* (2013.01)

(56) References Cited

U.S. PATENT DOCUMENTS

| | | | | |
|---|---|---|---|---|
| 3,127,865 | A | 4/1964 | Pleuger | |
| 3,888,083 | A | 6/1975 | Tone | |
| 3,983,833 | A | 10/1976 | Eickmann | |
| 5,252,875 | A | 10/1993 | Veronesi et al. | |
| 5,289,068 | A | 2/1994 | Veronesi et al. | |
| 6,009,822 | A | 1/2000 | Aron | |
| 6,099,367 | A | 8/2000 | White et al. | |
| 6,482,054 | B2 | 11/2002 | Treaster et al. | |
| 6,612,822 | B2 | 9/2003 | Buschur et al. | |
| 6,988,917 | B2 * | 1/2006 | Ohtsuki | B63H 23/26 440/75 |
| 8,584,609 | B2 | 11/2013 | Stasolla et al. | |
| 2005/0009418 | A1 | 1/2005 | Ries et al. | |
| 2009/0308298 | A1 * | 12/2009 | Gai | H01H 47/002 114/151 |
| 2011/0073029 | A1 | 3/2011 | Stasolla et al. | |
| 2011/0130056 | A1 | 6/2011 | Schulze et al. | |

FOREIGN PATENT DOCUMENTS

| | | | |
|---|---|---|---|
| EP | 0 316 219 | A1 | 5/1989 |
| GB | 158990 | A | 2/2021 |
| JP | 2015-33858 | A | 2/2015 |

OTHER PUBLICATIONS

International Search Report, dated Jan. 19, 2018, for International Application No. PCT/CA2017/051338, 4 pages.

* cited by examiner

THRUSTER APPARATUSES, AND METHODS OF OPERATING SAME

This application claims the benefit of, and priority to, U.S. provisional patent application No. 62/420,494 filed Nov. 10, 2016, the entire contents of which are incorporated by reference herein.

FIELD

This disclosure relates generally to propulsion systems, and more particularly to thruster apparatuses and methods of operating same.

RELATED ART

An aquatic vessel may include one or more thrusters, such as one or more as tunnel thrusters for example, which may allow the vessel to rotate or move laterally independently of a primary propulsion system of the vessel. One tunnel thruster includes a propeller mounted inside of a tunnel that extends transversely through a hull of the vessel. When the propeller rotates, it generates a thrust force that may be perpendicular to a main axis of the vessel to rotate the vessel or move the vessel laterally. At least some known thrusters are complex, inefficient, or both.

SUMMARY

According to one embodiment, there is disclosed a method of operating a thruster apparatus comprising first and second propellers, the method comprising: causing the first propeller to rotate in response to pressure of a first flow of pressurized hydraulic fluid; and causing the second propeller to rotate in response to pressure of a second flow of pressurized hydraulic fluid separate from the first flow of pressurized hydraulic fluid.

In some embodiments, the method further comprises separating a common source of pressurized hydraulic fluid into the first flow of pressurized hydraulic fluid and the second flow of pressurized hydraulic fluid.

In some embodiments: causing the first propeller to rotate comprises causing the first propeller to rotate in a first rotation direction; and causing the second propeller to rotate comprises causing the second propeller to rotate in a second rotation direction opposite the first rotation direction.

In some embodiments, the method further comprises reversing the first and second rotation directions.

In some embodiments, causing the first propeller to rotate comprises causing a first gerotor to impose a first torque on the first propeller in response to the pressure of the first flow of pressurized hydraulic fluid.

In some embodiments, causing the second propeller to rotate comprises causing a second gerotor to impose a second torque on the second propeller in response to the pressure of the second flow of pressurized hydraulic fluid.

According to another embodiment, there is disclosed a thruster apparatus comprising: first and second propellers; a means for rotating the first propeller in response to pressure of a first flow of pressurized hydraulic fluid; and a means for rotating the second propeller in response to pressure of a second flow of pressurized hydraulic fluid separate from the first flow of pressurized hydraulic fluid.

In some embodiments, the thruster apparatus further comprises a means for separating a first common source of pressurized hydraulic fluid into the first flow of pressurized hydraulic fluid and the second flow of pressurized hydraulic fluid.

In some embodiments: the means for rotating the first propeller is configured to rotate the first propeller in a first rotation direction in response to flow of the first common source of pressurized hydraulic fluid in a first flow direction; and the means for rotating the second propeller is configured to rotate the second propeller in a second rotation direction opposite the first rotation direction in response to flow of the first common source of pressurized hydraulic fluid in the first flow direction.

In some embodiments, the thruster apparatus further comprises: a means for separating a second common source of pressurized hydraulic fluid into a third flow of pressurized hydraulic fluid and a fourth flow of pressurized hydraulic fluid; wherein the means for rotating the first propeller is configured to rotate the first propeller in the second rotation direction in response to pressure of the third flow of pressurized hydraulic fluid when the second common source of pressurized hydraulic fluid flows in a second flow direction; and wherein the means for rotating the second propeller is configured to rotate the second propeller in the first rotation direction in response to pressure of the fourth flow of pressurized hydraulic fluid when the second common source of pressurized hydraulic fluid flows in the second flow direction.

According to another embodiment, there is disclosed a thruster apparatus comprising: first and second propellers; a first hydraulic motor configured to rotate the first propeller in response to pressure of a first flow of pressurized hydraulic fluid; and a second hydraulic motor configured to rotate the second propeller in response to pressure of a second flow of pressurized hydraulic fluid separate from the first flow of pressurized hydraulic fluid.

In some embodiments, the thruster apparatus further comprises a first fluid conduit configured to receive a first common source of pressurized hydraulic fluid and to separate the first common source of pressurized hydraulic fluid into the first flow of pressurized hydraulic fluid and the second flow of pressurized hydraulic fluid.

In some embodiments: the first hydraulic motor is configured to rotate the first propeller in a first rotation direction in response to flow of the first common source of pressurized hydraulic fluid in a first flow direction; and the second hydraulic motor is configured to rotate the second propeller in a second rotation direction opposite the first rotation direction in response to flow of the first common source of pressurized hydraulic fluid in the first flow direction.

In some embodiments, the thruster apparatus further comprises: a second fluid conduit configured to receive a second common source of pressurized hydraulic fluid and to separate the second common source of pressurized hydraulic fluid into a third flow of pressurized hydraulic fluid and a fourth flow of pressurized hydraulic fluid; wherein the first hydraulic motor is configured to rotate the first propeller in the second rotation direction in response to pressure of the third flow of pressurized hydraulic fluid when the second common source of pressurized hydraulic fluid flows in a second flow direction; and wherein the second hydraulic motor is configured to rotate the second propeller in the first rotation direction in response to pressure of the fourth flow of pressurized hydraulic fluid when the second common source of pressurized hydraulic fluid flows in the second flow direction.

In some embodiments, the first hydraulic motor comprises a first gerotor.

In some embodiments, the second hydraulic motor comprises a second gerotor.

In some embodiments, the thruster apparatus further comprises: a first drive shaft coupling the first hydraulic motor to the first propeller; and a second drive shaft coupling the second hydraulic motor to the second propeller.

In some embodiments: the first hydraulic motor is configured to rotate the first propeller independently of any gears between the first hydraulic motor and the first propeller; and the second hydraulic motor is configured to rotate the second propeller independently of any gears between the second hydraulic motor and the second propeller.

In some embodiments, the first and second propellers are positioned in a thruster channel.

In some embodiments, the first and second hydraulic motors are positioned in the thruster channel between the first and second propellers.

Other aspects and features will become apparent to those ordinarily skilled in the art upon review of the following description of illustrative embodiments in conjunction with the accompanying figures.

DETAILED DESCRIPTION

Figure 1:
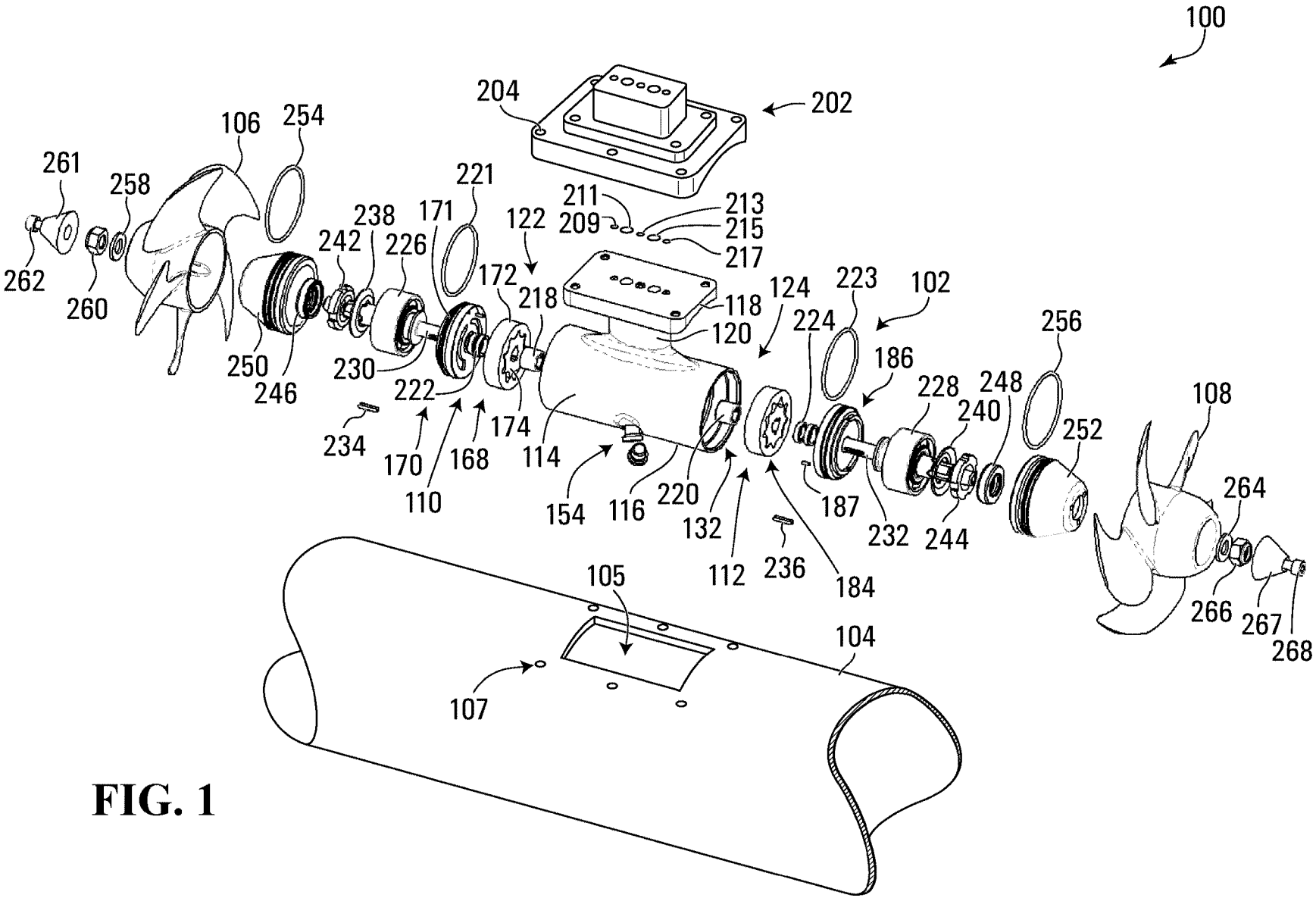
FIG. 1 is an exploded top perspective view of a thruster assembly according to one embodiment.

Referring to FIG. 1, a thruster assembly according to one embodiment is shown generally at 100 and includes a thruster apparatus shown generally 102, a mounting assembly 202, and a thruster tunnel 104. In some embodiments the thruster apparatus 102 may function as a tunnel thruster when, for example, the thruster assembly is mounted in the thruster tunnel 104.

The thruster apparatus 102 includes a first propeller 106, a second propeller 108, a first hydraulic motor assembly shown generally at 110, and a second hydraulic motor assembly shown generally at 112. In some embodiments, first and second propellers 106 and 108 may be referred to as impellers or as rotors. The thruster apparatus 102 also includes a thruster body 114 having a generally cylindrical body 116, a mounting body 118, and a strut 120 connecting the generally cylindrical body 116 to the mounting body 118. The generally cylindrical body 116 is open at a first end shown generally at 122 and at a second end shown generally at 124.

Figure 2:
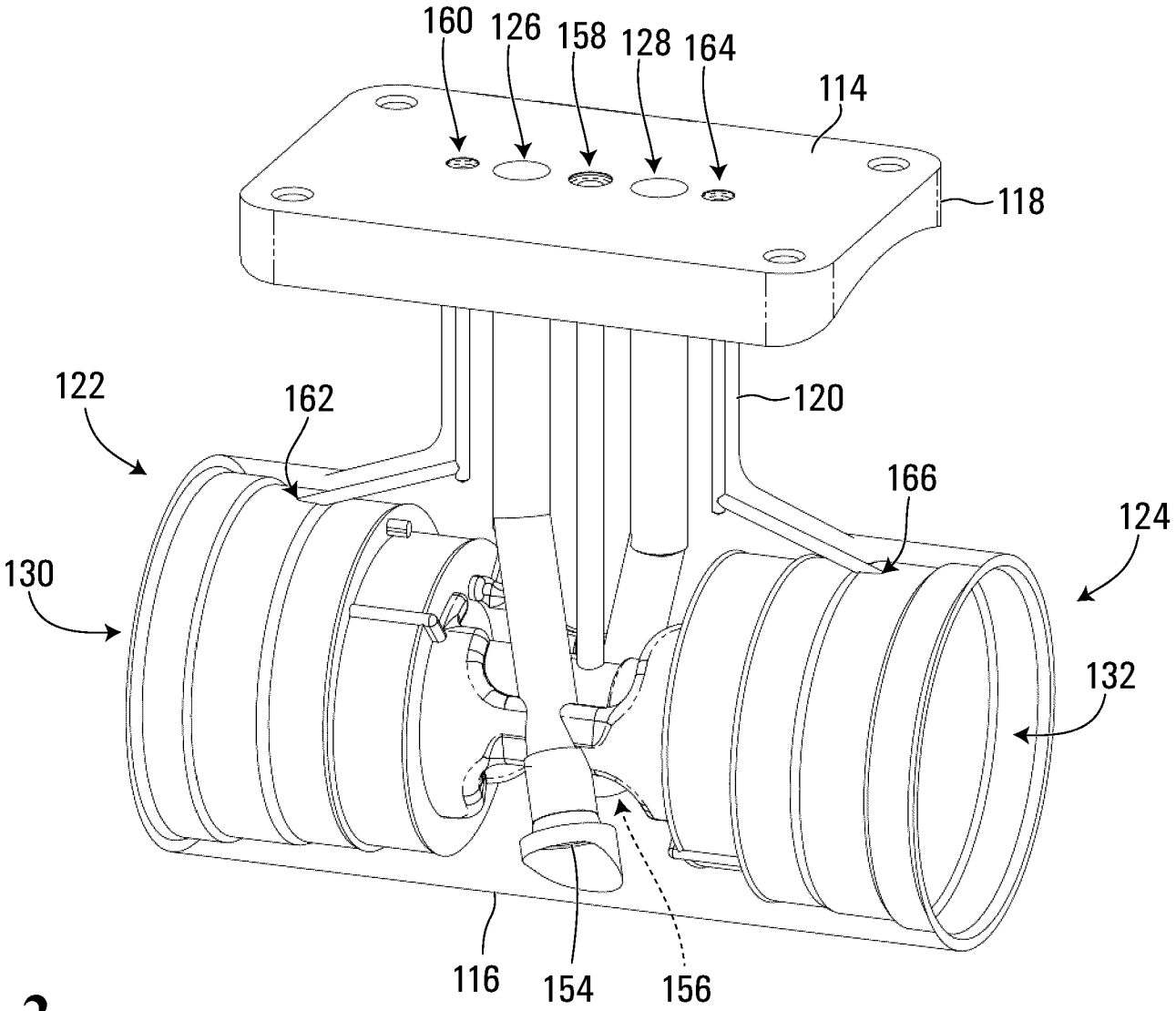
FIG. 2 is a top perspective view of a thruster body of the thruster assembly of FIG. 1.

Referring to FIGS. 1 and 2, the thruster body 114 defines first and second fluid conduits shown generally at 126 and 128 and extending through the mounting body 118 and the strut 120 and into the generally cylindrical body 116. On the first side 122, the generally cylindrical body 116 defines a first generally cylindrical receptacle shown generally at 130, and on the second side 124, the generally cylindrical body 116 defines a second generally cylindrical receptacle shown generally at 132.

Figure 3:
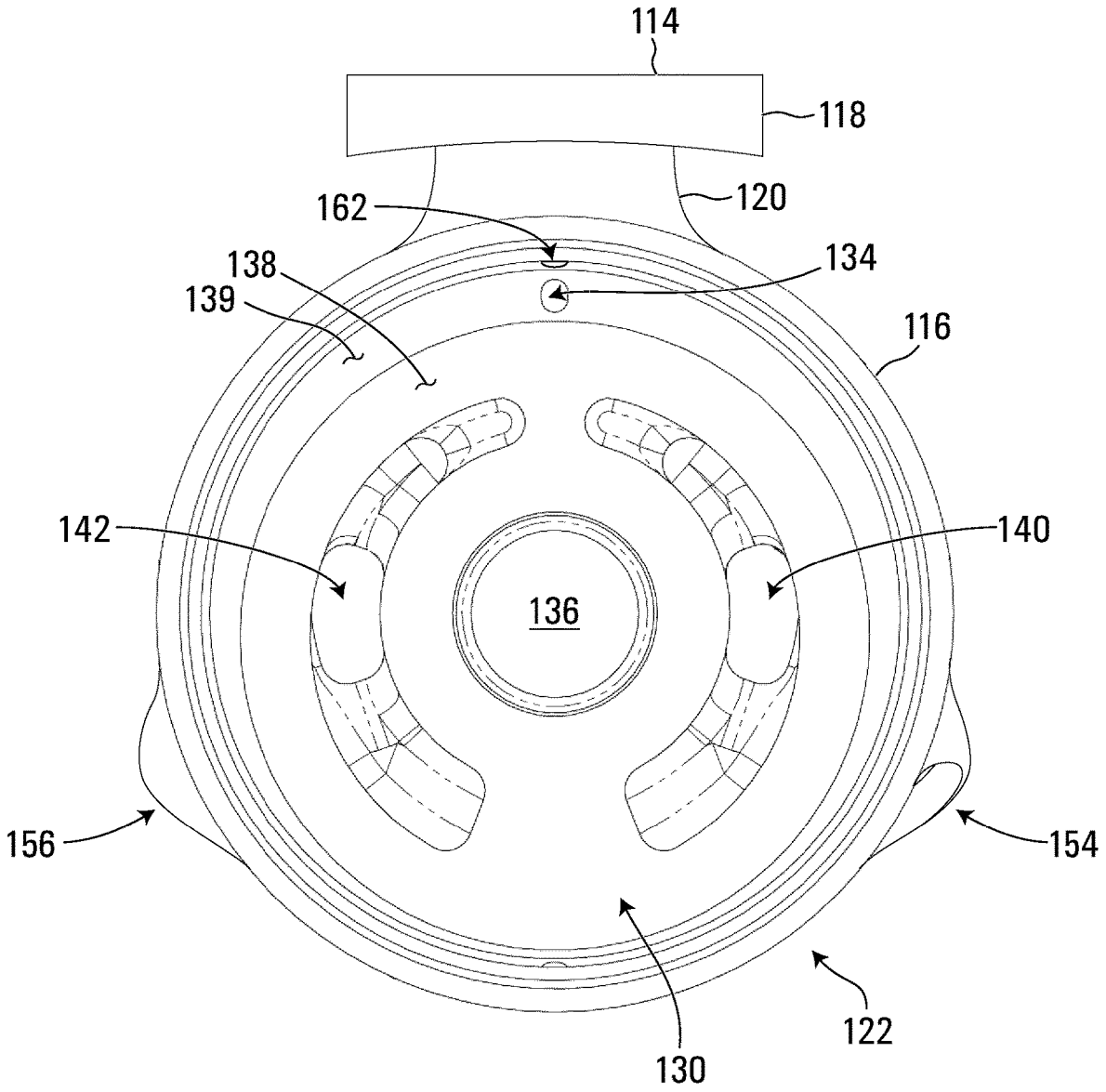
FIG. 3 is an elevation view of a first end of the thruster body of FIG. 2.

Referring to FIGS. 2 and 3, on the first side 122, the generally cylindrical body 116 defines a receptacle shown generally at 134 for receiving a first rotation-prevention member 171 as described below. Receptacle 130 is adjacent a generally cylindrical receptacle 136 configured to receive a first inner bearing 218 as described below. An inner surface 138 of the receptacle 130 surrounds the generally cylindrical receptacle 136, and defines a kidney-shaped hydraulic fluid port shown generally at 140 in fluid communication with the first hydraulic fluid conduit 126, and a kidney-shaped hydraulic fluid port shown generally at 142 and in fluid communication with the second hydraulic fluid conduit 128. Receptacle 130 defines a surface 139 facing the first side 122, surrounding the receptacle 136, and spaced apart from the inner surface 138 towards the first side 122.

Figure 4:
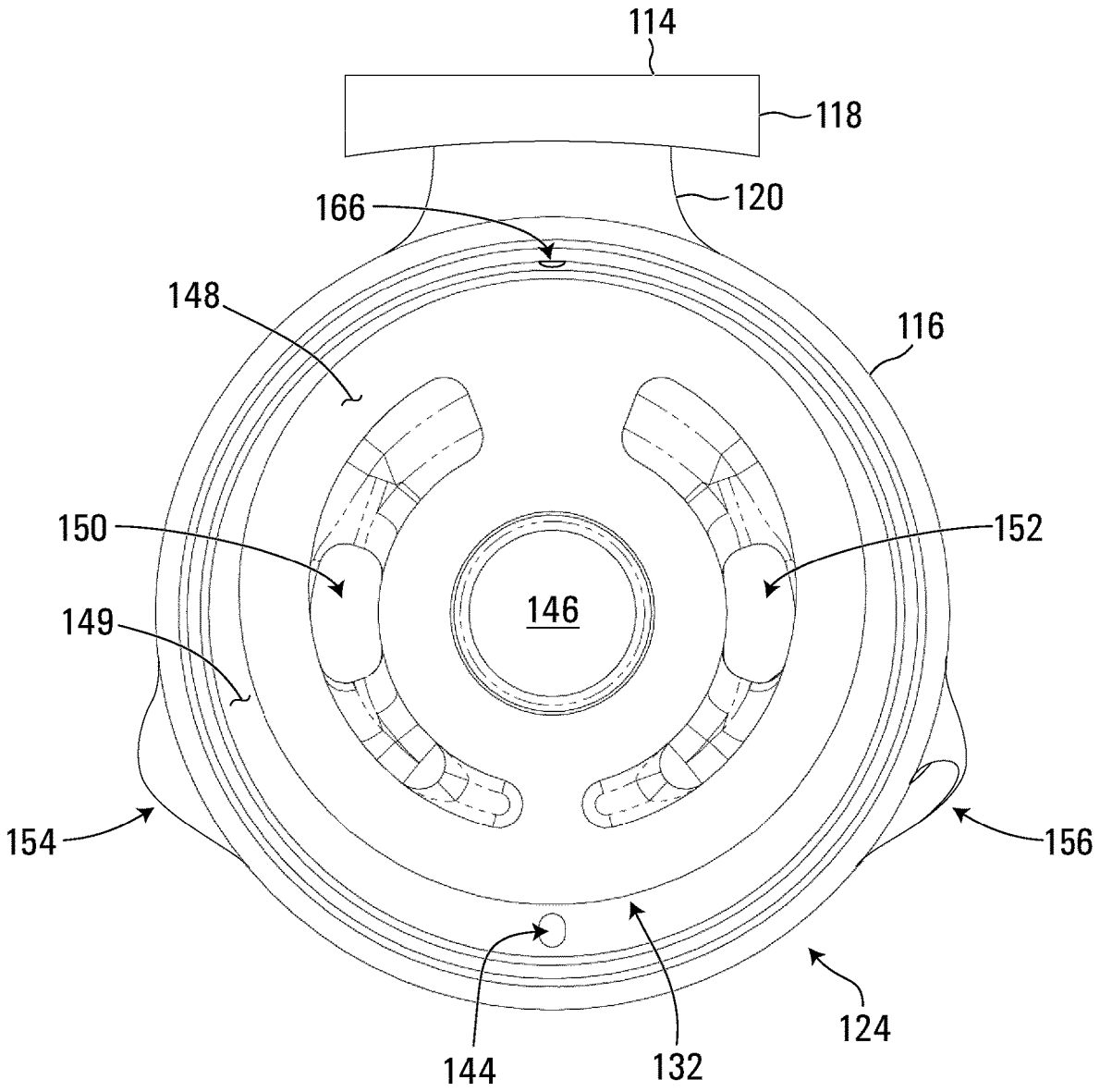
FIG. 4 is an elevation view of a second end of the thruster body of FIG. 2.

Referring to FIGS. 2 and 4, on the second side 124, the generally cylindrical body 116 defines a receptacle shown generally at 144 for receiving a second rotation-prevention member 187 as described below. Receptacle 132 is adjacent a generally cylindrical receptacle 146 configured to receive a second inner bearing 220 as described below. An inner surface 148 surrounds the generally cylindrical receptacle 146, and defines a kidney-shaped hydraulic fluid port shown generally at 150 in fluid communication with the hydraulic fluid conduit 126, and a kidney-shaped hydraulic fluid port shown generally at 152 in fluid communication with the hydraulic fluid conduit 128. Receptacle 132 defines a surface 149 facing the second side 124, surrounding the receptacle 146, and spaced apart from the inner surface 148 towards the second side 124. The ports 140 and 150 are on one side of the generally cylindrical body 116, and the ports 142 and 152 are on an opposite side of the generally cylindrical body 116. Further, the shapes of the ports 150 and 152 are upside-down relative to the shapes of the ports 140 and 142.

Referring to FIGS. 2-4, the thruster body 114 defines a drain shown generally at 154 for draining the first hydraulic fluid conduit 126, and a drain shown generally at 156 for draining the second hydraulic fluid conduit 128. During normal operation, the drains 154 and 156 may be closed with drain plugs (not shown). The generally cylindrical receptacles 136 and 146 are in fluid communication with each other, and with a fluid conduit shown generally at 158 that extends through the mounting body 118 and the strut 120 into a space between the generally cylindrical receptacles 136 and 146.

On the first side 122, the thruster body 114 defines a lubricant conduit shown generally at 160 and in communication with a lubricant outlet shown generally at 162 in the receptacle 130, and the thruster body 114 also defines a lubricant conduit shown generally at 164 in fluid communication with a lubricant outlet shown generally at 166 in the receptacle 132.

Figure 5:
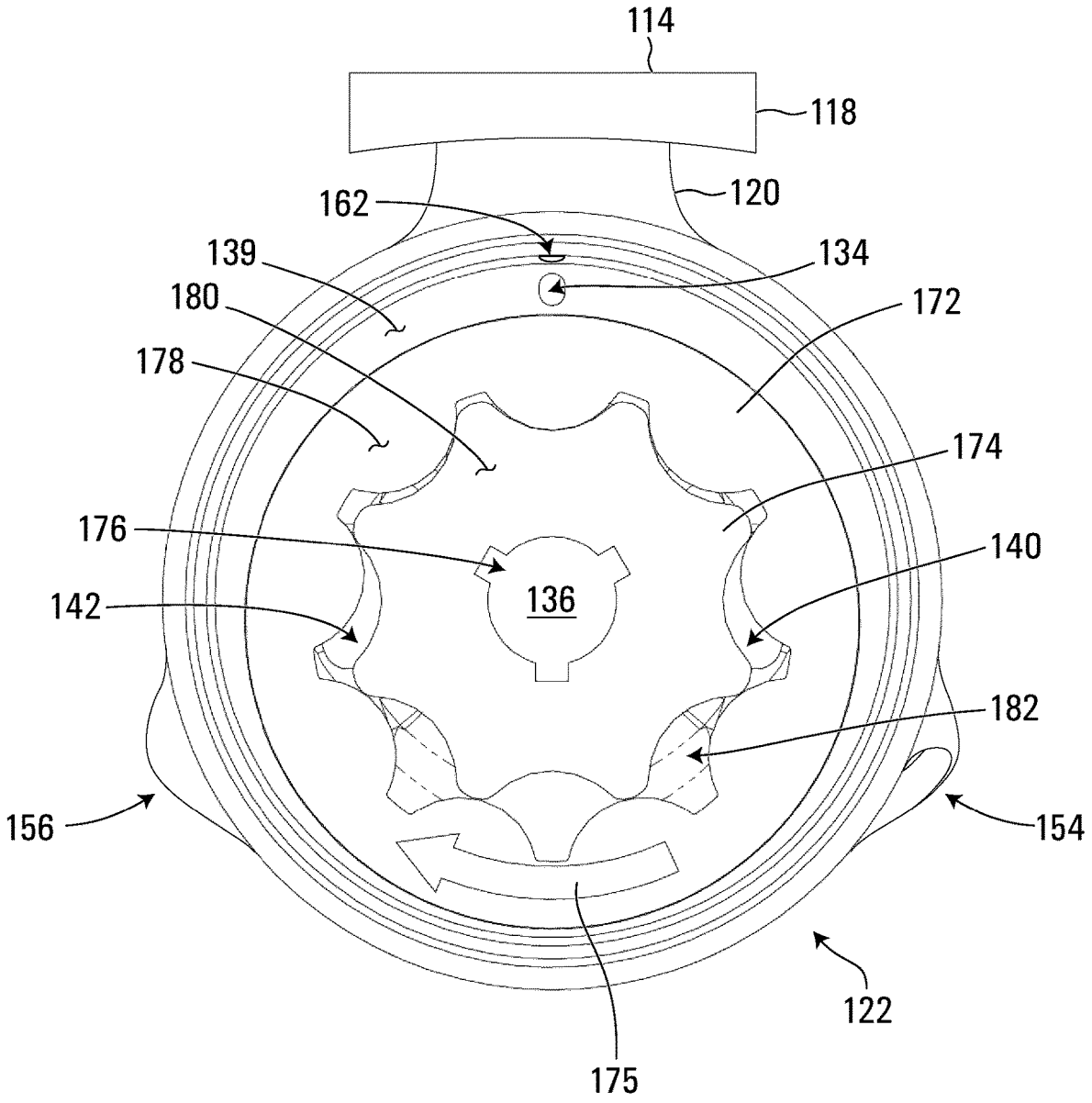
FIG. 5 is an elevation view of a hydraulic motor mounted to the first end of the thruster body of FIG. 2.
Figure 7:
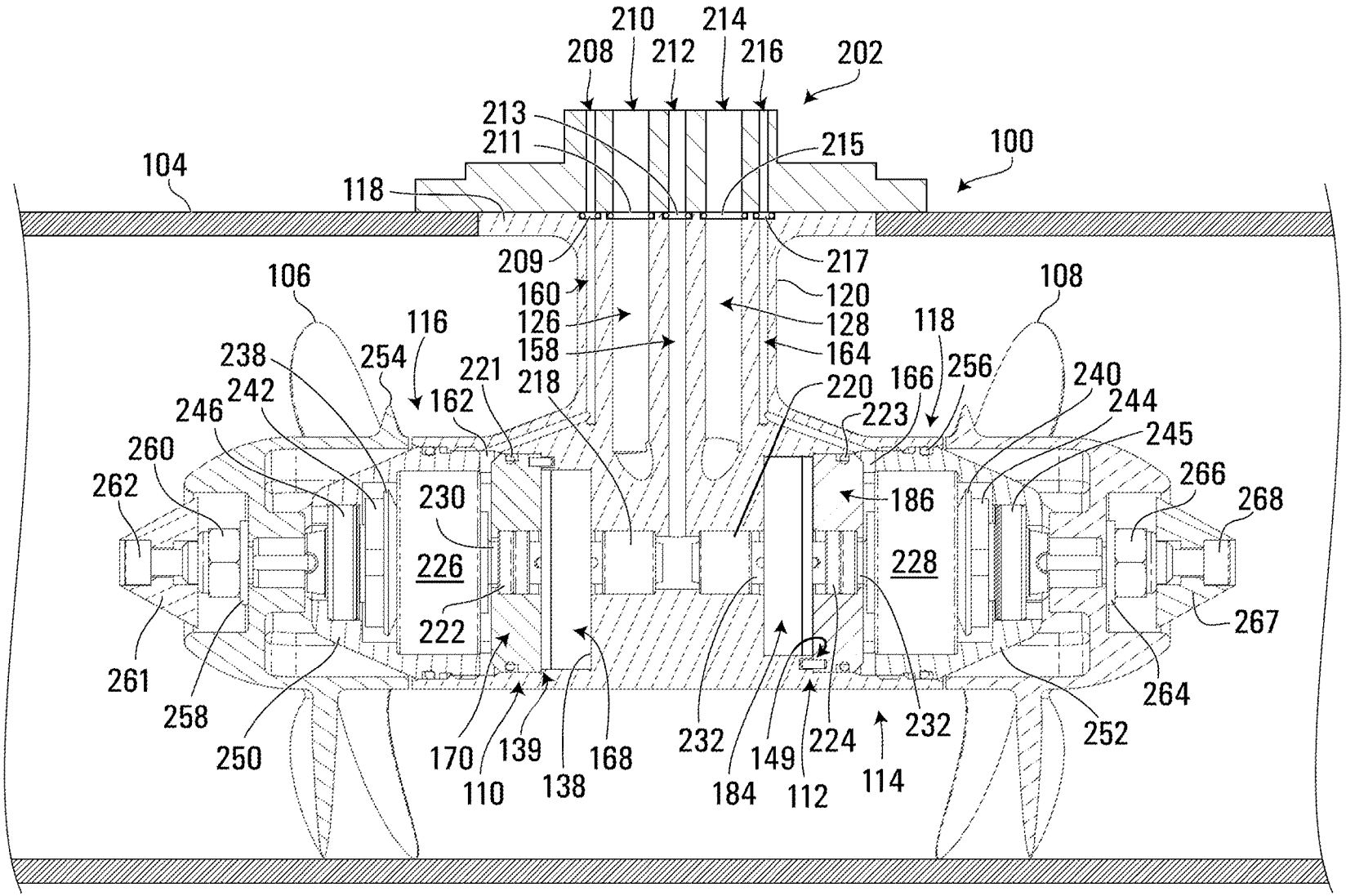
FIG. 7 is an assembled side cross-sectional view of the thruster assembly of FIG. 1.

Referring to FIGS. 1, 5, and 7, the first hydraulic motor assembly 110 may be mounted in the first end 122 of thruster body 114. The first hydraulic motor assembly 110 includes a gerotor assembly shown generally at 168 and a backing body shown generally at 170. The gerotor assembly 168 includes an external gear 172 and an internal gear 174 having one fewer teeth than the external gear 172. Internal gear 174 and external gear 172 are designed such that the teeth are always touching, thereby forming gaps between the sets of teeth such as gap 182 shown generally on FIG. 5. The gerotor assembly 168 may be positioned within the receptacle 130 and against the inner surface 138 (shown in FIG. 3), as shown in FIGS. 5 and 7, such that internal gear 174 is centered about receptacle 136 but a center of external gear 172 is spaced apart from a center of receptacle 136 in a direction away from strut 120. Internal gear 174 defines a through-hole 176 aligned with the receptacle 136 when gerotor assembly 168 is received in eccentric receptacle 130. External gear 172 and internal gear 174 define surfaces 178 and 180 respectively which are generally flush with one another.

In operation, a source of pressurized hydraulic fluid (not shown) provides a flow of pressurized hydraulic fluid through the conduit 126 and into the kidney-shaped hydraulic fluid port 140. The pressurized hydraulic fluid flows into the gaps such as gap 182 shown generally on FIG. 5 and causes the teeth of internal gear 174 and external gear 172 to rotate in receptacle 130 in the direction which would cause the gaps such as gap 182 to increase in size. In the case of gerotor assembly 168, due to placement of kidney-shaped hydraulic fluid port 140 and the eccentric placement of receptacle 130, the gerotor assembly 168 is forced to rotate in a clockwise direction (in the orientation of FIG. 5) shown generally by arrow 175 in order to increase the space in the gaps such as gap 182 in response to pressure from hydraulic fluid received through the kidney-shaped hydraulic fluid port 140. As gerotor assembly 168 rotates, the internal gear 174 rotates at a faster speed than external gear 172. The eccentric displacement of external gear 172 causes gaps such as gap 182 to vary in size during rotation. The kidney-shaped hydraulic fluid ports 140 and 142 are sized such that when each gap such as gap 182 reaches its maximum size (allowing a maximum volume of hydraulic fluid into the gap), it is blocked from receiving the flow of hydraulic fluid from first kidney-shaped hydraulic fluid port 140, and opened to second kidney-shaped hydraulic fluid port 142. At this stage, the flow of pressurized hydraulic fluid from conduit 126 into the particular gap, such as gap 182, is stopped, and the hydraulic fluid in gap 182 is forced to flow into kidney-shaped hydraulic fluid port 142 and out the second hydraulic fluid conduit 128 due to the continued rotation of gerotor assembly 168. In some embodiments, leaking hydraulic fluid is drained through conduit 158.

Backing body 170 is sized to be received against surface 139 of the generally cylindrical body 116. Backing body 170 defines kidney-shaped cavities that may be aligned with the kidney-shaped hydraulic fluid ports 140 and 142 respectively (shown in FIG. 3). In operation, the first and second kidney-shaped cavities on backing body 170 may offset the pressure caused by the flow of pressurized hydraulic fluid into gerotor assembly 168 by balancing the axial load of the internal and external gears 172 and 174. Backing body 170 also defines a generally cylindrical through-hole that may be aligned with the generally cylindrical through-hole 176 of the internal gear 174 of gerotor assembly 168. In some embodiments, the thruster apparatus 102 may operate most effectively if there is clearance between surfaces 178 and 180 of gerotor assembly 168 and the backing body 170, thereby allowing the gerotor assembly 168 to rotate freely.

Figure 6:
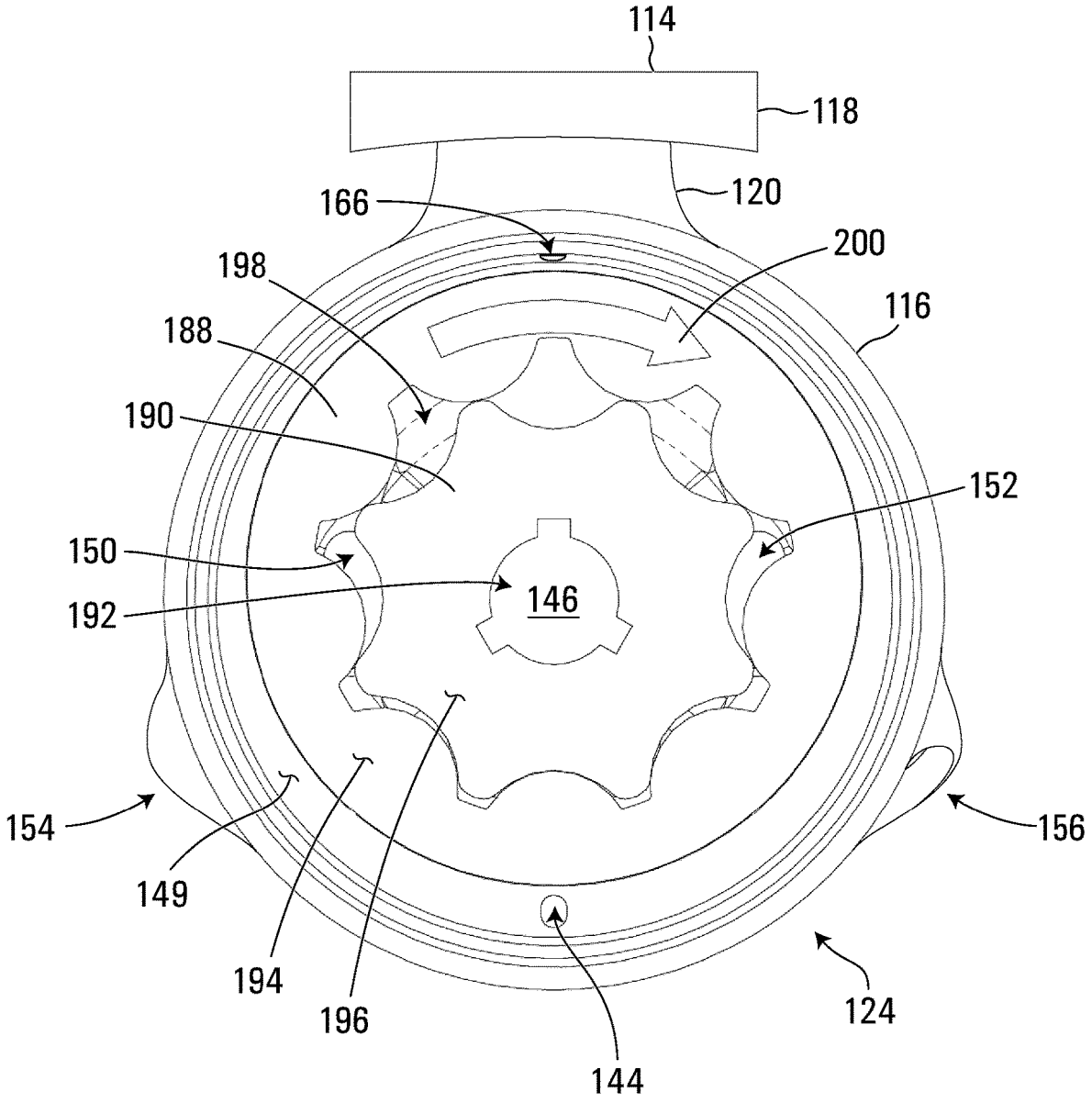
FIG. 6 is an elevation view of a hydraulic motor mounted to the second end of the thruster body of FIG. 2.

Referring to FIGS. 1, 6, and 7, the second hydraulic motor assembly 112 may be mounted in the second end 124 of thruster body 114. The second hydraulic motor assembly 112 includes a gerotor assembly shown generally at 184 and a backing body shown generally at 186. The gerotor assembly 184 includes an external gear 188 and an internal gear 190 having one fewer teeth than the external gear 188. Internal gear 190 and external gear 188 are designed such that the teeth are always touching, thereby forming gaps between the sets of teeth such as gap 198 shown generally on FIG. 6. The gerotor assembly 184 may be positioned within the receptacle 132 and against the inner surface 148 (shown in FIG. 4), as shown in FIGS. 6 and 7, such that internal gear 190 is centered about receptacle 146 but a center of external gear 188 is spaced apart from a center of receptacle 146 in a direction toward strut 120. Internal gear 190 defines a through-hole 192 aligned with the receptacle 146 when gerotor assembly 184 is received in eccentric receptacle 132, through-hole 192 is aligned with receptacle 146. External gear 188 and internal gear 190 define surfaces 194 and 196 respectively which are generally flush with one another.

In operation, a source of pressurized hydraulic fluid (not shown) provides a flow of pressurized hydraulic fluid through the conduit 126 and into the kidney-shaped hydraulic fluid port 150. The pressurized hydraulic fluid flows into the gaps such as gap 198 shown generally on FIG. 6 and causes the teeth of internal gear 190 and external gear 188 to rotate in receptacle 132 in the direction which would cause the gaps such as gap 198 to increase in size. In the case of gerotor assembly 184, due to placement of kidney-shaped hydraulic fluid port 150 and the eccentric placement of receptacle 132, the gerotor assembly 184 is forced to rotate in a clockwise direction (in the orientation of FIG. 6) shown generally by arrow 200 and opposite the direction shown by arrow 175 in FIG. 5 in order to increase the space in the gaps such as gap 198 in response to pressure from hydraulic fluid received through the kidney-shaped hydraulic fluid port 150. As gerotor assembly 184 rotates, the internal gear 190 rotates at a faster speed than external gear 188. The eccentric displacement of external gear 188 causes gaps such as gap 198 to vary in size during rotation. The kidney-shaped hydraulic fluid ports 150 and 152 are sized such that when each gap such as gap 198 reaches its maximum size (allowing a maximum volume of hydraulic fluid into the gap), it is blocked from receiving the flow of hydraulic fluid from first kidney-shaped hydraulic fluid port 150, and opened to second kidney-shaped hydraulic fluid port 152. At this stage, the flow of pressurized hydraulic fluid from conduit 126 into the particular gap, such as gap 198, is stopped, and the hydraulic fluid in gap 198 is forced to flow into opened kidney-shaped hydraulic fluid port 152 and out the second hydraulic fluid conduit 128 due to the continued rotation of gerotor assembly 184. In some embodiments, leaking hydraulic fluid is drained through conduit 158.

Backing body 186 is sized to be received against surface 149 of the generally cylindrical body 116. Backing body 186 defines kidney-shaped cavities may be aligned with the kidney-shaped hydraulic fluid ports 150 and 152 respectively (shown in FIG. 4). In operation, first and second kidney-shaped cavities on backing body 186 may offset the pressure caused by the flow of pressurized hydraulic fluid into gerotor assembly 184 by balancing the axial load of the internal and external gears 188 and 190. Backing body 186 also defines a generally cylindrical through-hole that may be aligned with the generally cylindrical through-hole 192 of the internal gear 190 of gerotor assembly 184. In some embodiments, the thruster apparatus 102 may operate most effectively if there is clearance between surfaces 194 and 196 of gerotor assembly 184 and the backing body 186, thereby allowing the gerotor assembly 184 to rotate freely.

During operation, an amount of torque produced by gerotor assemblies 168 and 184 may be independent of the flow rate of pressurized hydraulic fluid from conduit 126 and may be related instead to the amount of pressure supplied to the gerotor assemblies 168 and 184. The two gerotor assemblies 168 and 184 are not mechanically linked, so the gerotor assemblies 168 and 184 can rotate the propellers 106 and 108 at different speeds.

Referring to FIGS. 1, 3, 4, 5, 6, and 7, thruster apparatus 102 may be assembled by positioning inner bearings 218 and 220 in generally circular receptacles 136 and 146 (shown in FIGS. 3 and 4) respectively. In some embodiments, inner bearings 218 and 220 may be needle bearings. Inner bearings 218 and 220 define generally cylindrical receptacles that may be aligned with the generally cylindrical through holes 176 and 198 of gerotor assemblies 168 and 184 respectively.

Gerotor assemblies 168 and 184 may then be positioned against surfaces 138 and 148 of receptacles 130 and 132 respectively of thruster body 114 as described above. Backing bodies 170 and 186 may then be positioned against gerotor assemblies 168 and 184 respectively as described above. The first and second rotation-prevention members 171 and 187 may be received in receptacles 134 and 144 respectively and may cooperate with the backing bodies 170 and 186 to align the generally cylindrical body 116 rotationally relative to the backing bodies 170 and 186 and to prevent the backing bodies 170 and 186 from rotating relative to the generally cylindrical body 116.

Inner o-rings 221 and 223 may then be positioned around backing bodies 170 and 186 respectively. In some embodiments, inner o-rings 221 and 223 may be −29 o-rings. Inner shaft seals 222 and 224 may then be positioned in the generally cylindrical through-holes of backing bodies 168 and 184 respectively. In some embodiments, inner shaft seals 222 and 224 may be 8 mm ID×22 mm OD×6 mm W radial shaft seals. The inner shaft seals 222 and 224 and inner o-rings 221 and 223 may prevent hydraulic fluid delivered by conduits 126 or 128, after being delivered to gerotor assemblies 168 and 184, from leaking out of an interior section of the thruster body 114 defined between inner o-rings 221 and 223. Inner shaft seals 222 and 224 and inner o-rings 221 and 223 may also prevent lubricant delivered via lubricant outlets 162 and 166 from leaking into the interior section of the thruster body 114 defined between inner o-rings 221 and 223.

Outer bearings 226 and 228 may then be positioned against backing bodies 170 and 186 respectively. Outer bearings 226 and 228 define generally cylindrical through-holes that may be aligned with the generally cylindrical through-holes in backing bodies 170 and 186. In some embodiments, outer bearings 226 and 228 may be angular contact ball bearings. In operation, outer bearings 226 and 228 may receive lubricant for decreasing friction during rotation via lubricant outlets 162 and 166 respectively, which are in fluid communication with lubricant conduits 160 and 164 respectively.

Next, drive shaft 230 may be inserted through the generally cylindrical through-holes of outer bearing 226, inner shaft seal 222, backing body 170, gerotor assembly 168, and received in the generally cylindrical receptacle of inner bearing 218. Similarly, drive shaft 232 may be inserted through the generally cylindrical through-holes of outer bearing 228, inner shaft seal 224, backing body 186, gerotor assembly 184, and received in the generally cylindrical receptacle of inner bearing 220. Gerotor keys 234 and 236 may then be positioned in corresponding gerotor key slots in drive shafts 230 and 232 in order to lock internal gears 174 and 190 to drive shafts 230 and 232 such that rotation of gerotor assemblies 168 and 184 causes drive shafts 230 and 232 respectively to rotate.

In some embodiments, drive shafts 230 and 232 each define a plurality of gerotor key slots. Gerotor keys 234 and 236 may then be positioned in one of the plurality of gerotor key slots on the drive shafts 230 and 232. The remaining gerotor key slots may be left open, and may be configured to be in fluid communication, through a center through-hole of each of drive shafts 230 and 232, with fluid conduit 158. In such embodiments, leaked fluid (either lubricant or hydraulic fluid) between the gerotor assemblies 168 and 184 and backing bodies 170 and 186 respectively may flow toward the central through-hole of each backing body and into the gerotor keyholes that remain open, and may then flow through the center of drive shafts 230 and 232 respectively into fluid conduit 158 for draining out of thruster assembly 102.

After drive shafts 230 and 232 have been positioned in thruster assembly 102, bearing lock washers 238 and 240 may be positioned on ends of drive shafts 230 and 232 and against outer bearings 226 and 228, followed by bearing lock nuts 242 and 244, which may lock drive shafts 230 and 232 into thruster assembly 102. Outer shaft seals 246 and 248 may then be positioned on the ends of drive shafts 230 and 232 through generally cylindrical through-holes defined on each of outer shaft seals 246 and 248. In some embodiments, outer seals 246 and 248 are 12 mm ID×22 mm OD×6 mm W radial shaft seals.

Next, end caps 250 and 252 may be positioned on the ends of drive shafts 230 and 232 and fixably coupled to first and second ends 122 and 124 of thruster body 114 respectively. In some embodiments, end caps 250 and 252 may be coupled to thruster body 114 by threading end caps 250 and 252 onto corresponding threads on inner annular surfaces of receptacles 130 and 132 respectively. End caps 250 and 252 each define generally cylindrical through-holes sized to receive drive shafts 230 and 232. Outer o-rings 254 and 256 may then be positioned around end caps 250 and 252 respectively. In some embodiments, outer o-rings may be −30 o-rings. Outer o-ring 254 and outer shaft seal 246 may prevent lubricant delivered via lubricant outlet 162 from leaking out of thruster body 114, and similarly may prevent exterior liquids, such as seawater, from entering end 122 of thruster body 114. Similarly, outer o-ring 256 and outer shaft seal 248 may prevent lubricant delivered via lubricant outlet 166 from leaking out of thruster body 114, and similarly may prevent exterior liquids, such as seawater, from entering end 124 of thruster body 114.

Next, first propeller 106 may be positioned against end cap 250 and fixably coupled to drive shaft 230 via washer 258, nut 260, anode 261, and head cap screw 262 such that rotation of drive shaft 230 causes first propeller 106 to rotate correspondingly and the gerotor assembly 168 is configured to rotate the propeller 106 independently of any gears between the gerotor assembly 168 and the propeller 106. Similarly, second propeller 108 may be positioned against end cap 252 and fixably coupled to drive shaft 232 via washer 264, nut 266, anode 267, and head cap screw 268 such that rotation of drive shaft 232 causes second propeller 108 to rotate correspondingly and the gerotor assembly 184 is configured to rotate the propeller 108 independently of any gears between the gerotor assembly 184 and the propeller 108. In some embodiments, washers 258 and 264 may be M8 washers. In some embodiments, nuts 260 and 266 may be M8×1.25 lock nuts. In some embodiments, head cap screws 262 and 268 may be M5×0.8×12 socket head cap screws. In some embodiments, anodes 261 and 267 may be comprised of aluminum metal.

In operation, the gerotor assembly 168 rotates the first propeller 106 in response to pressure of a first flow of pressurized hydraulic fluid (through the kidney-shaped hydraulic fluid port 140) and the gerotor assembly 184 rotates the second propeller 108 in response to pressure of a second flow of pressurized hydraulic fluid (through the kidney-shaped hydraulic fluid port 150), and fluid conduits in the thruster body 114 separate a first common source of pressurized hydraulic fluid (from the first hydraulic fluid conduit 126) into the first and second flows of pressurized hydraulic fluid.

In the embodiment shown, the first and second propellers 106 and 108 rotate about a parallel or common axis, being the longitudinally central axis of thruster body 114 defined by drive shafts 230 and 232. However, in the embodiment shown, due to the shapes of kidney-shaped fluid ports 140 and 142 being inverted with respect to kidney-shaped fluid ports 150 and 152, and due to external gear 174 of gerotor assembly 168 being eccentric from the longitudinal axis of thruster body 114 in a direction away from strut 120 while external gear 192 of gerotor assembly 184 is eccentric from the longitudinal axis of thruster body 114 in a direction toward strut 120, causing pressurized hydraulic fluid to flow into gerotor assemblies 168 and 184 causes gerotor assemblies 168 and 184 to rotate in opposite directions with respect to one another. This counter-rotation of gerotor assemblies 168 and 184 thereby causes drive shafts 230 and 232 to rotate in opposite directions with respect to one another, which in turn causes first and second propellers 106 and 108 to rotate in opposite directions with respect to one another. In the embodiment shown, first and second propellers 106 and 108 are pitched in opposite directions with respect to one another. Therefore, when first and second propellers are caused to rotate in opposite directions, the opposite pitches of the propellers produce a unified thrust in a longitudinal direction between the first and second propellers 106 and 108.

In some embodiments, the direction of rotation of each gerotor assembly 168 and 184 can be reversed by changing the direction of hydraulic fluid flow, such that the flow of pressurized hydraulic fluid enters each gerotor assembly via conduit 128 and is forced out via conduit 126, thereby causing each of gerotor assemblies 168 and 184 to rotate in directions opposite arrows 175 and 200 respectively. The gerotor assemblies 168 and 184 are thus rotated in substantially the same way as previously described, except that the direction of rotation of each is reversed and counter-clockwise in the orientation of FIGS. 5 and 6. When the direction of rotation is reversed, the gerotor assembly 168 rotates the first propeller 106 in response to pressure of a third flow of pressurized hydraulic fluid (through the kidney-shaped hydraulic fluid port 142) and the gerotor assembly 184 rotates the second propeller 108 in response to pressure of a fourth flow of pressurized hydraulic fluid (through the kidney-shaped hydraulic fluid port 152), and fluid conduits in the thruster body 114 separate a second common source of pressurized hydraulic fluid (from the second hydraulic fluid conduit 128) into the first and second flows of pressurized hydraulic fluid.

Thruster assembly 102 may be operably mounted in a tunnel such as thruster tunnel 104 having an opening 105 in order to provide directed thrust through the tunnel 104. In some embodiments, thruster tunnel 104 may extend transversely through a hull of a ship and may be aligned athwart to the ship in order to provide a means for maneuvering the ship in confined waters. For different embodiments, one skilled in the art may analyze fluid dynamics of the propellers to increase efficiency or avoid unwanted effects such as cavitation.

Figure 8:
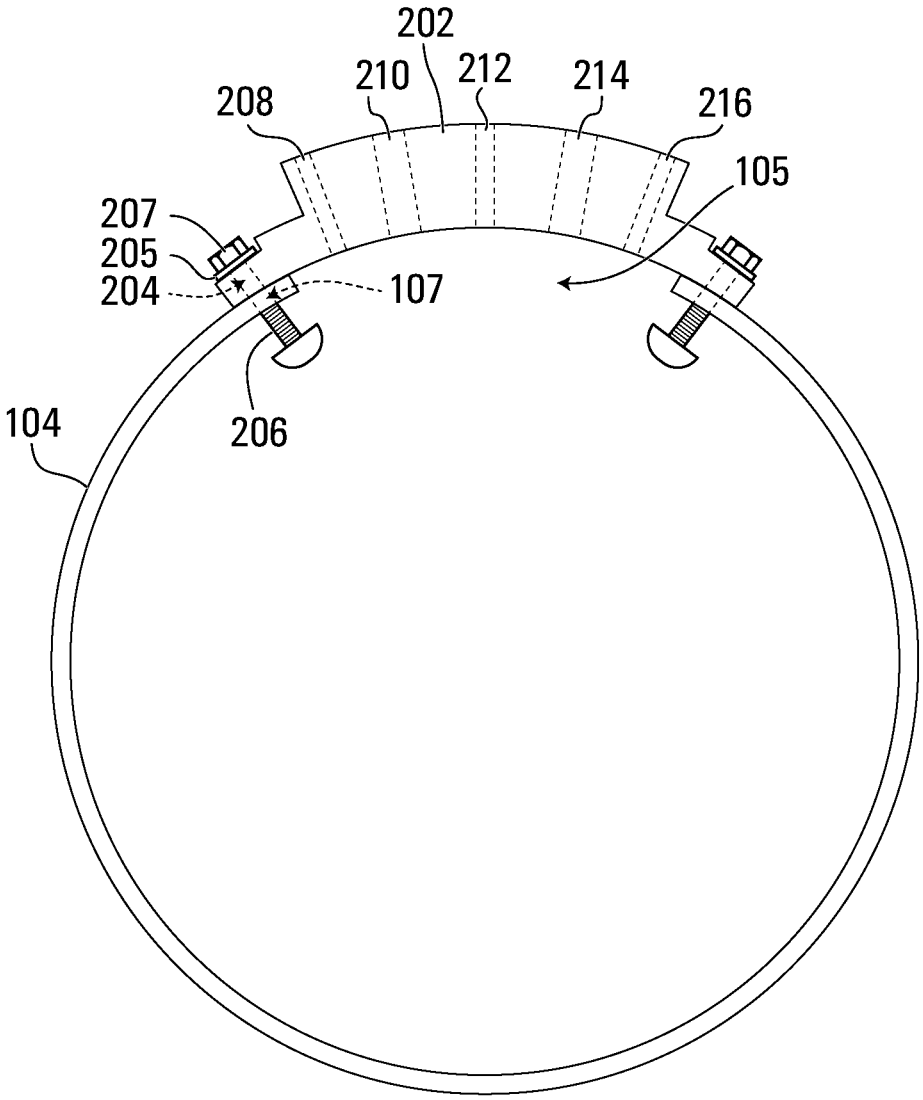
FIG. 8 is an elevation view of a first end of a tunnel and a mounting assembly of the thruster assembly of FIG. 1.
Figure 9:
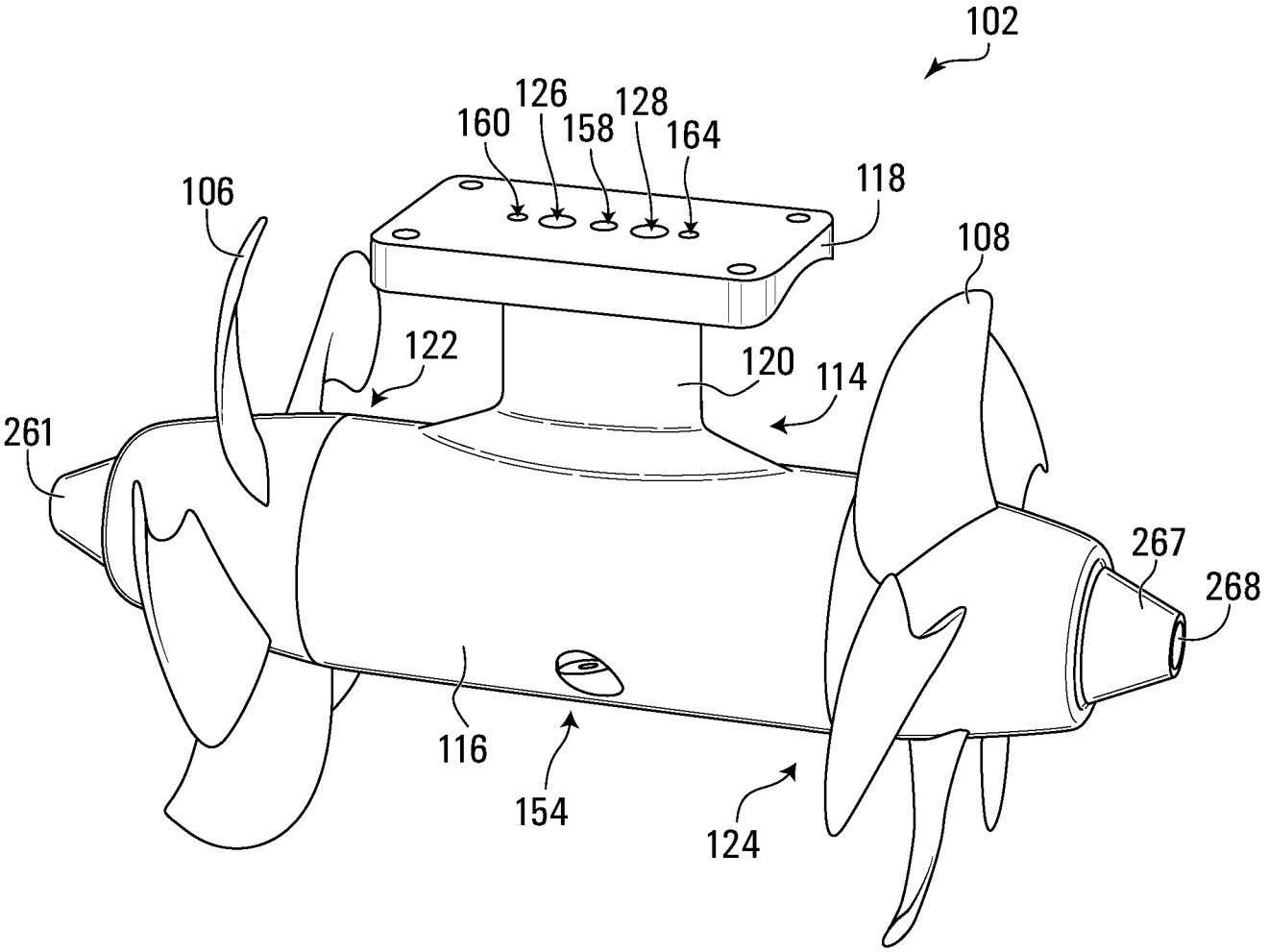
FIG. 9 is an assembled top perspective view of a thruster apparatus of the thruster assembly of FIG. 1.
Figure 10:
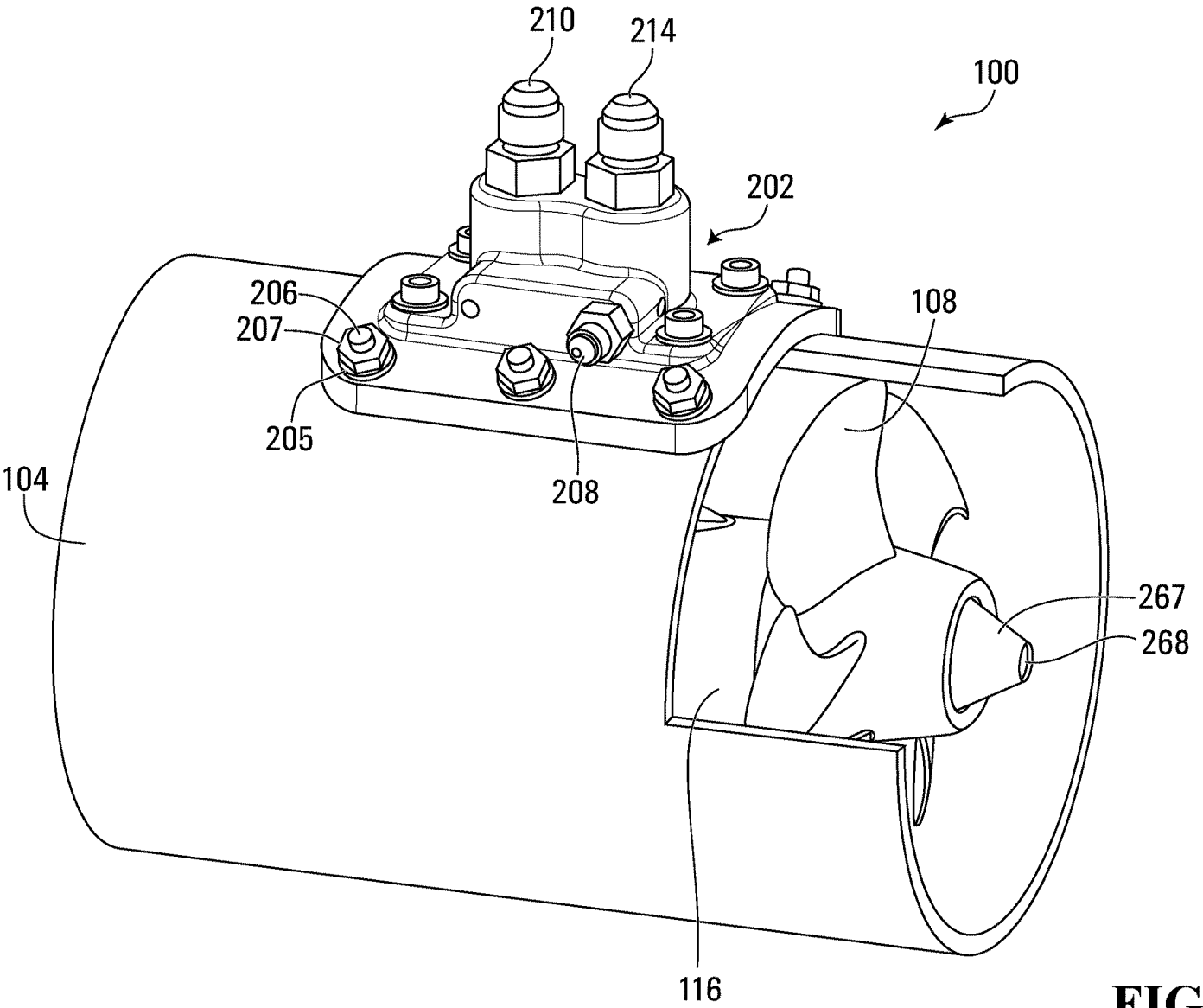
FIG. 10 is an assembled top perspective view of the thruster assembly of FIG. 1.
Figure 11:
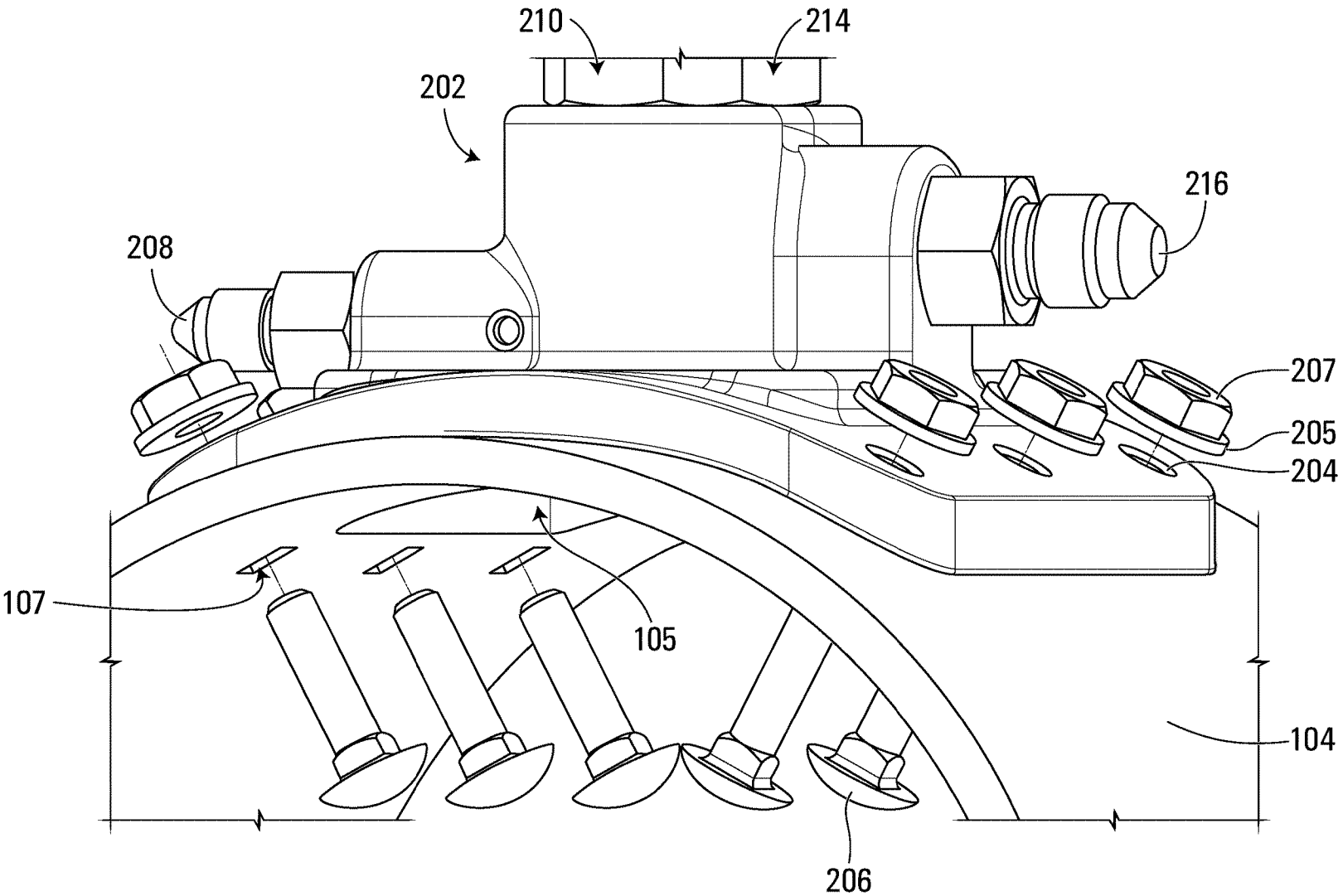
FIG. 11 is a side perspective view of the tunnel and mounting assembly of the thruster assembly of FIG. 1.
Figure 12:
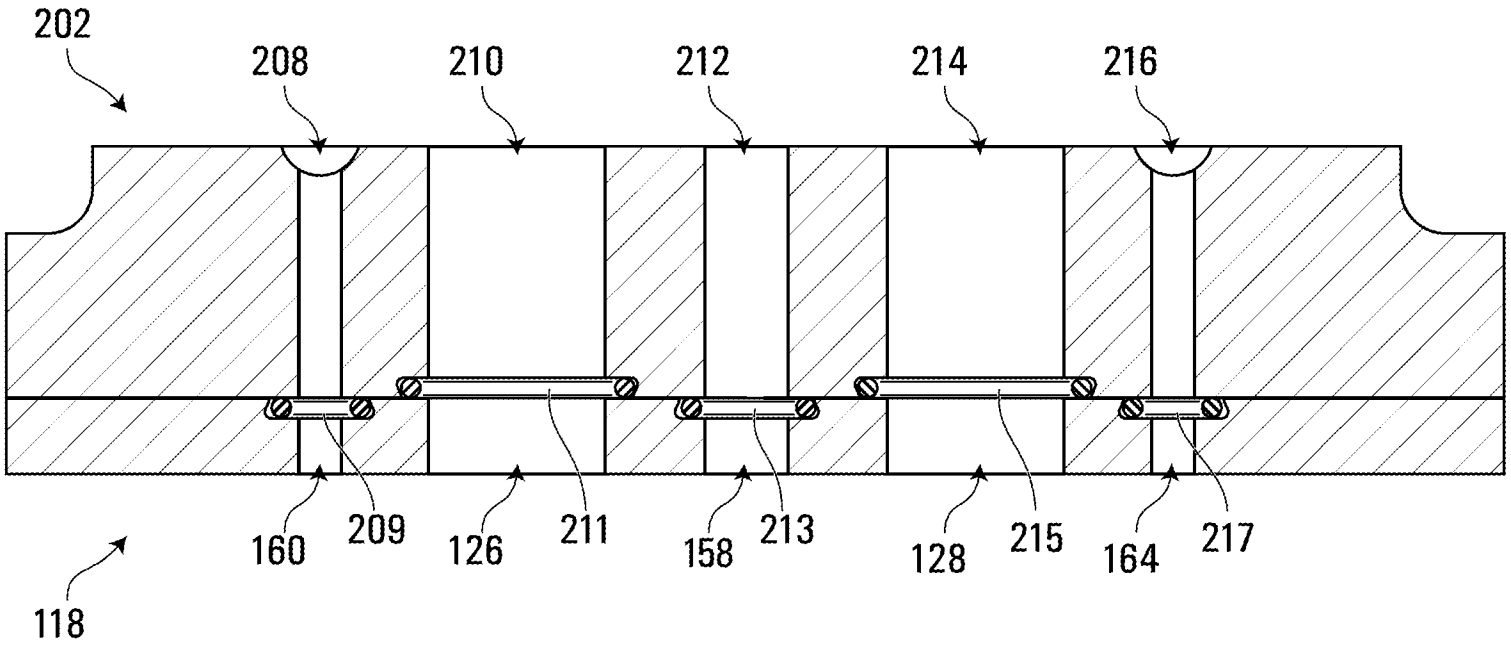
FIG. 12 is a cross-sectional view of the tunnel and mounting assembly of the thruster assembly of FIG. 1.

Referring to FIGS. 1, 7, and 8, mounting apparatus 202 defines a plurality of through-holes 204 for use with fasteners 206 (shown in FIG. 8) to fasten the mounting apparatus 202 to an outside of thruster tunnel 104. In some embodiments, through-holes 204 may be circular holes. In some embodiments, fasteners 206 may be #10-24×¾" carriage bolts which may be fastened by #10 flat washers and #10-24 hex nuts. Thruster tunnel 104 defines an opening 105 and a plurality of through-holes 107 surrounding opening 105 for receiving fasteners 206. In some embodiments, through-holes 107 may be square holes for locking fasteners 206 into place once inserted. Mounting apparatus 202 also defines fluid conduits 208, 210, 212, 214, and 216 which are sized to correspond with fluid conduits 160, 126, 158, 128, and 164 on mounting body 118 of thruster body 114 respectively.

Thruster assembly 102 may be mounted to thruster tunnel 104 using mounting assembly 202, as shown in FIGS. 1, 7, and 8. First mounting assembly 202 may be mounted to an outside surface of tunnel 104 centrally over opening 105. Fasteners 206 may be received from the inside of tunnel 104, through holes in the walls of tunnel 104, and into corresponding through-holes 204 in the mounting assembly 202. Washers 205 and nuts 207 may be tightened onto distal ends of fasteners 206 after being received in holes 204 of mounting assembly 202 in order to secure mounting assembly 202 to the outside surface of tunnel 104.

The thruster assembly 102 may then be detachably coupled to the mounting assembly 202 from within tunnel 104 by causing mounting body 118 of thruster assembly 102 to contact an underside of mounting assembly 202 through hole 105 of tunnel 104, such that fluid conduits 208, 210, 212, 214, and 216 align with corresponding fluid conduits 160, 126, 158, 128, and 164. Small o-rings 209, 213, and 217 may be received between conduits 208, 212, and 216 and corresponding conduits 160, 158, and 164 in order to prevent fluids from leaking out of said conduits between mounting assembly 202 and mounting body 118. In some embodiments, small o-rings 209, 213, and 217 may be 0.075" ID×0.039" thick o-rings. Similarly, large o-rings 211 and 215 may be received between conduits 210 and 212 and corresponding conduits 126 and 128. In some embodiments, large o-rings 211 and 215 may be 0.130" ID×0.039" thick o-rings. Mounting body 118 may be secured to mounting assembly 202 with a set of additional fasteners (not shown). In some embodiments, the set of additional fasteners may be #10-24×½" socket head screws.

Pumping hydraulic fluid directly into a thruster such as thruster assembly 100 may raise environmental concerns because, in the case of a leak, pressurized hydraulic fluid may be at risk of being pumped into the seawater. In the embodiment shown, inner shaft seals 222 and 224, inner o-rings 221 and 223, outer shaft seals 246 and 248, and outer o-rings 254 and 256 may be positioned at locations where leaks of lubricant and/or pressurized hydraulic fluid may occur. In some embodiments, thruster assembly 100 may be configured to notify a user that a leak of the lubricant or the pressurized hydraulic fluid has occurred in response to a change in a level of fluid inside the thruster body 114. Such a notification may allow the user to address the leak immediately and minimize fluid leakage. In some embodiments, fluid conduits 160 and 164 may be connected to a header tank (not shown) which is filled with lubricant up to a certain fluid height. If a leak occurs due to inner seals 222 or 224 and/or inner o-rings 221 and 223, hydraulic fluid from conduits 126 and/or 128 may inadvertently be pumped into areas of thruster body 114 containing outer bearings 226 and 228 and up fluid conduits 160 and/or 164 causing a rise in the fluid height in the header tank. If a leak occurs due to outer seals 246 and 248 and/or outer o-rings 254 and 256, then the lubricant may leak out of the thruster body 114 until the fluid height in the header tank is equal to a water level outside the thruster body 114. In some embodiments, the fluid height in the header tank may activate a float switch which notifies a user that a leak is occurring, and based on the direction in which the fluid height has increased or decreased, whether the leak is due to failure of one of inner seals 222 and 224 and inner o-rings 221 and 223, or one of outer seals 246 and 248 and outer o-rings 254 and 256. Such a leak detector is not limited to the embodiments described herein, but may be included in one or more of many different embodiments.

In the embodiment shown, thruster body 114 may provide a rigid connection for propellers 106 and 108 to a vessel, and may operate as a porting and a housing for gerotor assemblies 110 and 112. To support thrust loads from the propellers 106 and 108 and the pressure from the hydraulic fluid that is used to drive the propellers 106 and 108, the thruster body 114 in some embodiments may be made of 6061-T6 aluminum having an elastic modulus ($10^6$ psi) of 10, an ultimate tensile strength (ksi) of 45, and yield strength (ksi) of 40. In some embodiments, the combined thrust force of both propellers 106 and 108 may be 70 lbf, and the combined pressure exerted by the pressurized hydraulic fluid in fluid conduits 126 and 128 may be 2,250 psi.

To withstand the forces required to drive the propellers 106 and 108, the drive shafts 230 and 232 in some embodiments may be made of AISI 440C stainless steel (56 HRC) having an elastic modulus ($10^6$ psi) of 29, an ultimate tensile strength (ksi) of 260, and yield strength (ksi) of 240, and propellers 106 and 108 may be made of C87800 die cast brass having an elastic modulus ($10^6$ psi) of 20, an ultimate tensile strength (ksi) of 84.8, and yield strength (ksi) of 45. The thrust force on each of propellers 106 and 108 may be 50 lbf. In some embodiments, the torque exerted on each of drive shafts 230 and 232 may be 63 lbf-in.

To transmit the required torque to drive shafts 230 and 232, the gerotor keys 234 and 236 in some embodiments may be 2 mm square DIN 6885 keys made from AISI 1045 steel. In various embodiments, a calculation to facilitate identification of an appropriate gerotor key may be done as follows:

1. Calculate the force (F) shearing the key due to shaft torque.

$$F=T/d$$

where T=shaft torque (lbf-in) and d=shaft diameter (in). For example, a 63 lbf-in and 0.315 in for the torque and shaft diameters yields a 200 lbf force.

2. Calculate the safety factors for shearing ($n_s$) and crushing ($n_c$) the keys.

$$n_s = \frac{S_{sy}tl}{F}$$

-continued $$n_c = \frac{S_y tl}{2F}$$

where $S_{sy}$=shear yield strength (psi), $S_y$=tensile yield strength (psi), t=key width (in), l=key length (in). For example, if $S_{sy}$=(0.577) $S_y$ and using 70,000 psi, 0.079 in, and 0.375 for $S_y$, t, and l, respectively, $n_s$=5.96 and $n_c$=5.16. Various safety factors may be acceptable for different applications.

In the embodiment shown, once thruster apparatus 102 is assembled, end caps 250 and 252 may exert an inward force against outer bearings 226 and 228 respectively, which may exert a corresponding force against backing bodies 170 and 186 respectively, which may exert corresponding forces inward against first and second sides 122 and 124 of thruster body 114 respectively. Therefore, in the embodiment shown, end caps 250 and 252 may contain pressure caused by the pressurized hydraulic fluid contained in gerotor assemblies 168 and 184 respectively. In some embodiments, if the threaded length of engagement is short, then the threads may strip. In various embodiments, a calculation to facilitate identification of an appropriate threaded length of engagement may be done as follows:

1. Calculate the shear area ($A_S$) of the thread (thread is 1.75"-18 UNS) for the given length of engagement using the following formula:

$$A_S = 3.1416\, nL_e K_n\max\left[\frac{1}{2n} + 0.57735(E_s\min - K_n\max)\right]$$

where $A_S$=shear area ($in^2$), n=number of threads per inch (TPI), $E_S$min=minimum pitch diameter of the external thread (in), $K_n$max=maximum minor diameter of the internal thread (in), $L_e$=length of engagement (in). Using 18 TPI, 1.7073", 1.703", and 0.127" for n, $E_S$min, $K_n$max, and $L_e$, respectively, $A_S$=0.370 $in^2$. Values for $E_S$min and $K_n$max may be obtained from Machinery's Handbook.

2. Calculate the thread shear stress due to the pressure exerted on the gerotor backing plate and the end cap thread pretension. In some embodiments, the distribution of pressure on the gerotor backing plate may be unknown, so the worst case may be considered where everything but the low-pressure side pocket of the backing plate sees the 2,250 psi operating pressure. The end cap preload ($F_i$) may be set to be 1,000 lbf.

The stress (τ) may be given by the following formula:

$$\tau = \frac{PA_P + F_i}{A_S}$$

where P=operating pressure (psi), $F_i$=thread pretension (lbf), $A_P$=pressure area ($in^2$). The pressure area may be obtained from SolidWorks and may be 1.77 $in^2$ in some embodiments, yielding τ=13.7 ksi.

3. Calculate the factor of safety (SF) against shear yield stress.

$$SF = \frac{S_{sy}}{\tau} = \frac{0.577\, S_y}{\tau}$$

Using the yield strength ($S_y$) for 6061-T6 aluminum yields SF=1.69.

Alternative embodiments may differ in many different ways from the embodiments described above. For example, alternative embodiments may include more or fewer components, or different components. As examples only, alternative embodiments may include different motors, such as different hydraulic motors for example, and different conduits, connectors, fasteners, seals, propellers, bearings, shafts, or keys. Some embodiments may include electric motors instead of hydraulic motors. Further, components of alternative embodiments may include different materials and may have different sizes, shapes, positions, or orientations, for example.

Embodiments such as those described herein may be more efficient than other thruster systems, for example allowing the propellers 106 and 108 to rotate at different speeds may allow the propellers 106 and 108 to rotate at their most efficient speeds, which may be determined by a respective torque on drive shaft 230 or 232 (as the case may be) and on surrounding hydrodynamics without being restricted by the other propeller. Further, counter-rotating the propellers 106 and 108 may recover energy that may otherwise have been lost. Further, hydraulic motors such as the gerotor assemblies 168 and 184 may avoid gearing inefficiencies or noise in thruster systems that include gears.

Although specific embodiments have been described and illustrated, such embodiments should be considered illustrative only and not as limiting the invention as construed according to the accompanying claims.

The invention claimed is:

1. A thruster apparatus comprising:

a thruster tunnel defining a thruster channel extending between opposite open ends of the thruster channel;

first and second propellers in the thruster channel between the opposite open ends of the thruster channel;

a first motor configured to rotate the first propeller;

a second motor configured to rotate the second propeller;

wherein the first and second motors are positioned in the thruster channel, wherein:

the first motor is a first hydraulic motor configured to rotate the first propeller in response to pressure of a first flow of pressurized hydraulic fluid; and the second motor is a second hydraulic motor configured to rotate the second propeller in response to pressure of a second flow of pressurized hydraulic fluid separate from the first flow of pressurized hydraulic fluid.

2. The thruster apparatus of claim 1, further comprising a first fluid conduit configured to receive a first common source of pressurized hydraulic fluid and to separate the first common source of pressurized hydraulic fluid into the first flow of pressurized hydraulic fluid and the second flow of pressurized hydraulic fluid.

3. The thruster apparatus of claim 2, wherein:

the first hydraulic motor is configured to rotate the first propeller in a first rotation direction in response to flow of the first common source of pressurized hydraulic fluid in first flow direction; and the second hydraulic motor is configured to rotate the second propeller in a second rotation direction opposite the first rotation direction in response to flow of the first common source of pressurized hydraulic fluid in the first flow direction.

4. A thruster apparatus comprising:

first and second propellers;

a first hydraulic motor configured to rotate the first propeller in response to pressure of a first flow of pressurized hydraulic fluid;

a second hydraulic motor configured to rotate the second propeller in response to pressure of a second flow of pressurized hydraulic fluid separate from the first flow of pressurized hydraulic fluid;

a first fluid conduit configured to receive a first common source of pressurized hydraulic fluid and to separate the first common source of pressurized hydraulic fluid into the first flow of pressurized hydraulic fluid and the second flow of pressurized hydraulic fluid, wherein the first hydraulic motor is configured to rotate the first propeller in a first rotation direction in response to flow of the first common source of pressurized hydraulic fluid in a first flow direction, and wherein the second hydraulic motor is configured to rotate the second propeller in a second rotation direction opposite the first rotation direction in response to flow of the first common source of pressurized hydraulic fluid in the first flow direction; and a second fluid conduit configured to receive a second common source of pressurized hydraulic fluid and to separate the second common source of pressurized hydraulic fluid into a third flow of pressurized hydraulic fluid and a fourth flow of pressurized hydraulic fluid, wherein the first hydraulic motor is configured to rotate the first propeller in the second rotation direction in response to pressure of the third flow of pressurized hydraulic fluid when the second common source of pressurized hydraulic fluid flows in a second flow direction, and wherein the second hydraulic motor is configured to rotate the second propeller in the first rotation direction in response to pressure of the fourth flow of pressurized hydraulic fluid when the second common source of pressurized hydraulic fluid flows in the second flow direction.

5. The thruster apparatus of claim 1, wherein the first hydraulic motor comprises a first gerotor.

6. The thruster apparatus of claim 5, wherein the second hydraulic motor comprises a second gerotor.

7. The thruster apparatus of claim 1, further comprising:

a first drive shaft coupling the first hydraulic motor to the first propeller; and a second drive shaft coupling the second hydraulic motor to the second propeller.

8. The thruster apparatus of claim 1, wherein: the first hydraulic motor is configured to rotate the first propeller independently of any gears between the first hydraulic motor and the first propeller, and the second hydraulic motor is configured to rotate the second propeller independently of any gears between the second hydraulic motor and the second propeller.

9. The thruster apparatus of claim 1, wherein the thruster channel extends transversely through a hull of a ship.

10. The thruster apparatus of claim 9, wherein the first and second hydraulic motors are positioned in the thruster channel between the first and second propellers.

11. The thruster apparatus of claim 1, wherein the first and second hydraulic motors are positioned in the thruster channel between the first and second propellers.

12. The thruster apparatus of claim 1, further comprising a thruster body in the thruster channel, wherein fluid conduits in the thruster body are configured to separate the first common source of pressurized hydraulic fluid into the first flow of pressurized hydraulic fluid and the second flow of pressurized hydraulic fluid.

13. The thruster apparatus of claim 12, wherein the thruster channel extends transversely through a hull of a ship.

14. The thruster apparatus of claim 12, wherein the fluid conduits in the thruster body are configured to separate the first common source of pressurized hydraulic fluid into the first flow of pressurized hydraulic fluid and the second flow of pressurized hydraulic fluid at a location between the first and second hydraulic motors.

15. The thruster apparatus of claim 1, wherein:

the first hydraulic motor is configured to receive the first flow of pressurized hydraulic fluid from the first common source of pressurized hydraulic fluid independently of any controller, between the first fluid conduit and the first hydraulic motor, of flow of the first common source of pressurized hydraulic fluid to the first hydraulic motor; and the second hydraulic motor is configured to receive the second flow of pressurized hydraulic fluid from the first common source of pressurized hydraulic fluid independently of any controller, between the first fluid conduit and the second hydraulic motor, of flow of the first common source of pressurized hydraulic fluid to the second hydraulic motor.

16. The thruster apparatus of claim 1, wherein:

only a fluid conduit between the first fluid conduit and the first hydraulic motor is configured to control flow of the first flow of pressurized hydraulic fluid from the first common source of pressurized hydraulic fluid to the first hydraulic motor; and only a fluid conduit between the first fluid conduit and the second hydraulic motor is configured to control flow of the second flow of pressurized hydraulic fluid from the first common source of pressurized hydraulic fluid to the second hydraulic motor.

17. The thruster apparatus of claim 2, further comprising:

a second fluid conduit configured to receive a second common source of pressurized hydraulic fluid and to separate the second common source of pressurized hydraulic fluid into a third flow of pressurized hydraulic fluid and a fourth flow of pressurized hydraulic fluid, wherein the first hydraulic motor is configured to, in response to pressure of the third flow of pressurized hydraulic fluid separated from the second common source of pressurized hydraulic fluid, rotate the first propeller in an opposite direction than in response to pressure of the first flow of pressurized hydraulic fluid separated from the first common source of pressurized hydraulic fluid, and wherein the second hydraulic motor is configured to, in response to pressure of the fourth flow of pressurized hydraulic fluid separated from the second common source of pressurized hydraulic fluid, rotate the second propeller in an opposite direction than in response to pressure of the second flow of pressurized hydraulic fluid separated from the first common source of pressurized hydraulic fluid.

18. The thruster apparatus of claim 4, further comprising a thruster tunnel defining a thruster channel extending between opposite open ends of the thruster channel, wherein the first and second propellers in the thruster channel between the opposite open ends of the thruster channel.

* * * * *